United States Patent [19]

Clayton et al.

[11] 4,017,942

[45] Apr. 19, 1977

[54] TEXTILE CARDING

[75] Inventors: Malcolm Clayton, Huddersfield; Keith Grimshaw, Todmorden, both of England

[73] Assignee: The English Card Clothing Company Limited, England

[22] Filed: July 15, 1974

[21] Appl. No.: 488,818

[30] Foreign Application Priority Data

July 31, 1973 United Kingdom ..... 36353/73

[52] U.S. Cl. ..... 19/106 R

[51] Int. Cl.[2] ..... D01G 15/46

[58] Field of Search ..... 19/106 R, 258, 150; 26/154, 155, 166, 167

[56] References Cited

UNITED STATES PATENTS

| | | | |
|---|---|---|---|
| 3,283,366 | 11/1966 | Kalwaites | 19/106 R |
| 3,481,004 | 12/1969 | Wright et al. | 19/106 R X |

FOREIGN PATENTS OR APPLICATIONS

| | | | |
|---|---|---|---|
| 470,497 | 3/1969 | Switzerland | 19/106 R |
| 3,444 | 1862 | United Kingdom | 19/106 R |

*Primary Examiner*—Dorsey Newton

*Attorney, Agent, or Firm*—Norris & Bateman

[57] ABSTRACT

A method and apparatus whereby a carded web is removed from a rotating member carrying the web by passing the web through a mouth constituted by a nip between a rotating element such as a stripping roller which may have a non-circular cross-section and a stationary element such as a blade-like member that may be oscillated toward and away from the rotating element, the mouth continuously opening and closing in a plane radial of the rotating element.

10 Claims, 6 Drawing Figures

TEXTILE CARDING

Figure 1:
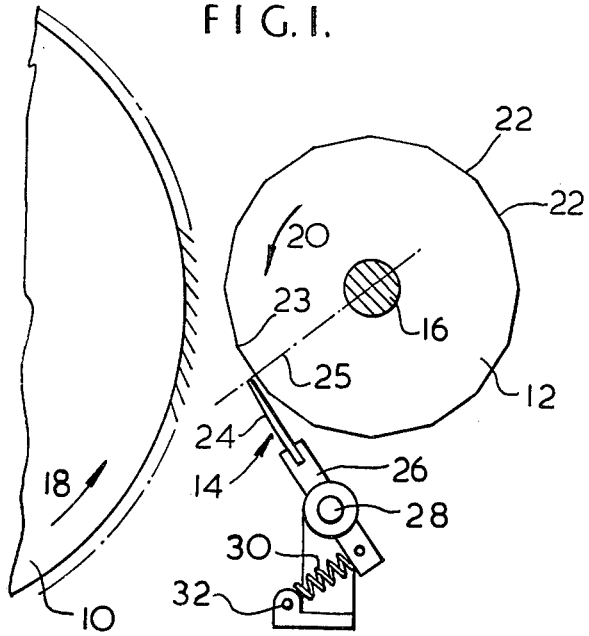

At the output end of a textile carding machine, the carded web of fibres has to be removed from the final card-clothed roller (usually a doffer roller). The conventional method of removing the web is by means of an oscillating doffing comb, but there are certain disadvantages with this method, one being the limitation it places on the speed of operation of the machine, because of the physical limitations on the frequency of comb oscillation, and another being that the comb does produce some distortion of the fibre arrangement in the web.

It is also known to use trains of stripping rollers, the arrangement of which is such that the fibres become progressively less securely fixed to the rollers as they travel along the train, so that eventually the fibre web can be pulled off the roller train, for example, by a pair of nip rollers. It has also been proposed to remove the carded web of fibres by passing it through the nip between a roller and a stationary blade which is disposed tangential to the roller and presses against the cylindrical surface of the roller.

It is the principal object of this invention to provide an improved method of removing fibrous web from a card-clothed roller or like rotating member, and in particular, to provide a method which is capable of operation at the high speeds suitable for high production carding. Although it is thought that the principal use for the invention will be in the removal of the carded web from a doffer, it is to be understood that it is not restricted to that particular application. The invention can be used to transfer a web from any card-clothed roller, and thus could be used, for example, to assist in the transfer from a cylinder or swift to the doffer. The invention also includes within its ambit, apparatus for carrying out the improved method.

According to one aspect of the invention a carded web of fibres is removed from a rotating member carrying the web, by passing the web through a mouth between a rotating element and a non-rotating element, the mouth continuously opening and closing in a plane radial of the rotating element.

In a preferred method of carrying out the invention, the rotating element is a stripping roller and the non-rotating element is a blade-like member, the mouth being constituted by the nip (i.e. the point of closest approach) of the stripping roller and the blade-like member. Thus, in one arrangement the web is removed by passing it through a nip between a stripping roller and a blade-like member part of which is close to the surface of the stripping roller, there being continuous relative movement of at least part of the blade-like member and the stripping roller to provide the opening and closing mouth.

According to one method of carrying out the invention, the web is removed by passing it between the periphery of a stripping roller and a non-rotating member arranged close to the stripping roller, the stripping roller having a non-circular cross-section, whereby the periphery of the roller approaches and recedes from the non-rotating member, due to the rotation of the roller, and this produces the opening and closing mouth. Preferably the stripping roller is an angular prism (e.g. triangular square or polygonal) so that if the non-rotating member is spaced from the stripping roller, then the point of closest approach of the roller periphery to the non-rotating member (nip) which corresponds to one of the corners of the prismatic shape, travels along the non-rotating member due to rotation of the roller, in addition to approaching and then receding from the non-rotating member to provide the opening and closing mouth between the stripping roller and the non-rotating member. In that event, the web-removing action of a nip is followed by that of a succeeding nip. Alternatively, if the non-rotating member engages with the non-circular periphery of the stripping roller, then the roller will cause the non-rotating member to oscillate relatively to the axis of the stripping roller thus providing the opening and closing mouth.

Preferably, the non-rotating member is a blade-like member at least part of which is arranged close to the peripheral surface of the stripping roller. The blade-like member may or may not actually contact the periphery of the stripping roller.

According to another aspect of the invention, apparatus for carrying out the method comprises a stripping roller mounted for rotation about its own axis, and a blade-like member at least part of which is disposed close to the periphery of the stripping roller and means for causing continuous opening and closing of the mouth formed between the stripping roller and the blade-like member.

According to a preferred feature of the invention, the stripping roller has a non-circular cross-section so that during its rotation, either its periphery approaches and recedes from the blade-like member if the latter is spaced from the roller, or it causes the blade-like member to oscillate relatively to the axis of the stripping roller if the blade-like member contacts the roller. In a preferred construction, the stripping roller is of polygonal cross-section, so that each of the corners of the roller in turn travels in close proximity to the blade-like member, providing a nip for the fibrous web.

The blade-like member may be arranged to oscillate towards and away from the stripping roller to provide the opening and closing mouth effect. Thus for example, if the stripping roller has the polygonal shape, the blade-like member may be resiliently loaded towards the stripping roller so that it oscillates due to its continual engagement and disengagement with the succeeding corners of the stripping roller as the latter rotates. Alternatively, the blade-like member may be resiliently loaded towards the stripping roller, and separate cam means may be provided for causing oscillation of the blade-like member. Again, there may be an electrically operated mechanism for producing oscillation of the blade-like member. In any event, the blade-like member may be arranged to contact the periphery of the stripping roller, or it may be arranged so that it never actually contacts the stripping roller but approaches close to the periphery of that roller.

The blade-like member may be arranged to extend on both sides of the radial plane of the stripping roller, which is perpendicular to the surface of the blade-like member nearest to the stripping roller, or it may be arranged to extend only on that side of the said radial plane, which is furthest from the side at which the carded web of fibres enters the mouth between the stripping roller and the blade.

Although the blade is preferably made of flexible material such as spring steel, or plastics material such as nylon, it could be made of rigid material, and if the blade is required to oscillate, it may be carried by brackets which mount the blade on pivots. Again, the blade may be made of resilient material and urged into engagement with the periphery of the stripping roller. In that case, it is preferred to provide means for adjusting the load applied to the blade.

According to another preferred feature of the invention means are provided for adjusting the setting of the blade relatively to the stripping roller. Preferably a plurality of setting adjusting means are provided at spaced positions transversely of the width of the apparatus, and the arrangement is such that it is possible to effect localised adjustment of the setting of part of the blade.

In a preferred form, the blade is resiliently mounted, and a plurality of transversely spaced screw adjusting devices are provided for adjusting localised areas of the blade in the vicinity of each respective adjusting device.

Figure 2:
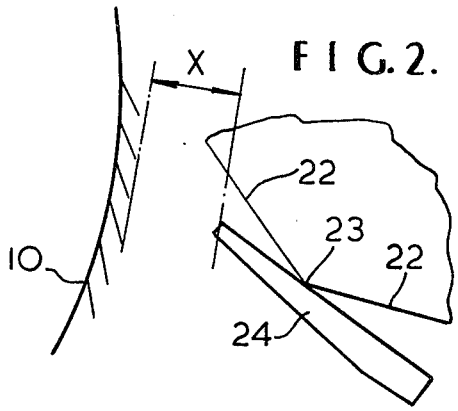
Figure 3:
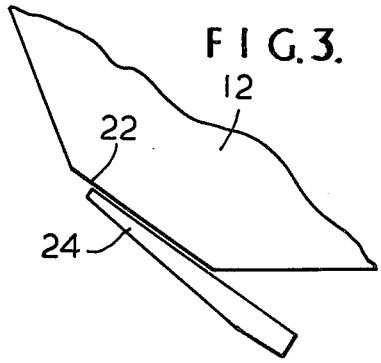
Figure 4:
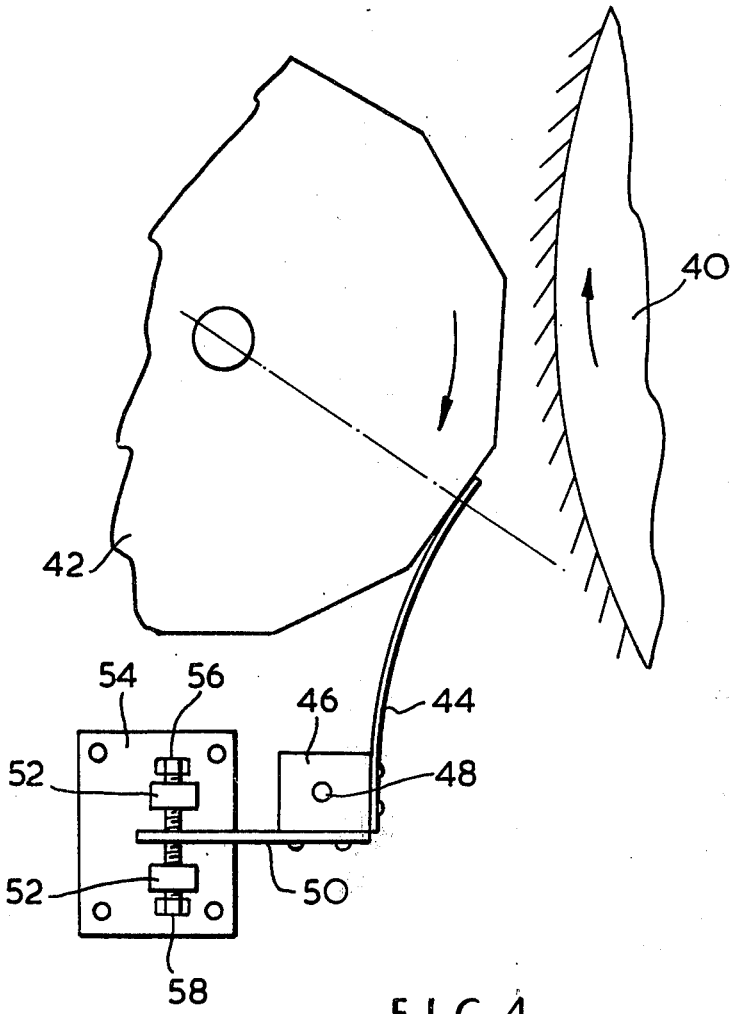
Figure 5:
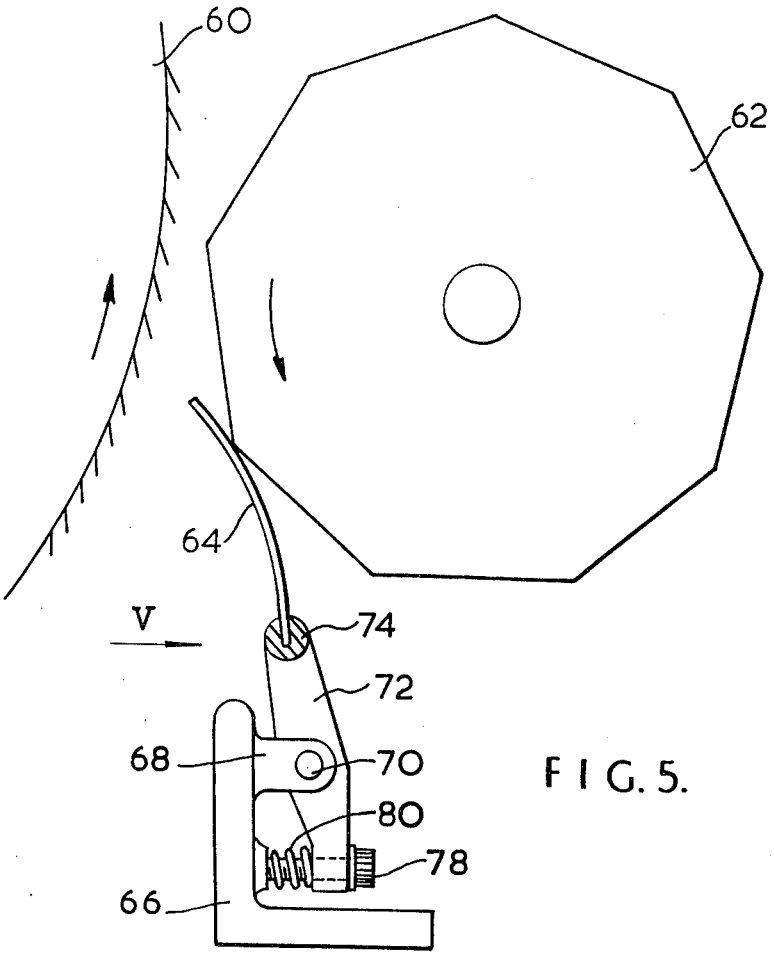
Figure 6:
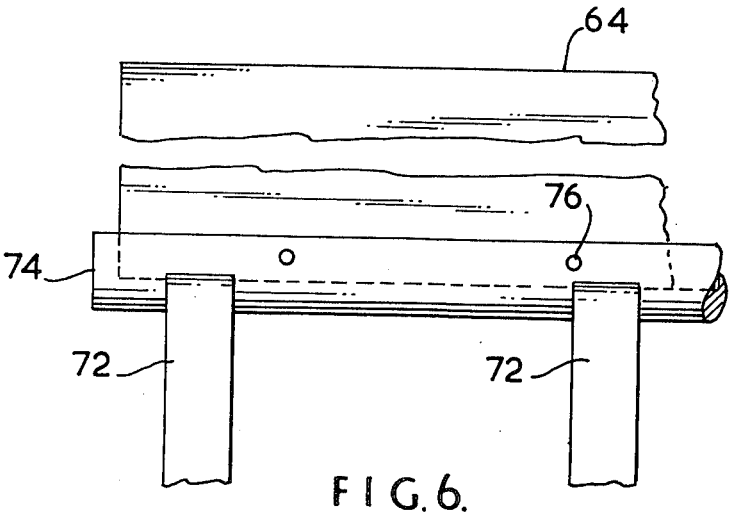

Four arrangements for removing a carded web from the last card-clothed roller of a carding machine and their method of operation, will now be described by way of example only, with reference to the accompanying drawings, in which:

FIG. 1 is a diagrammatic end view of one form of apparatus,

FIG. 2 is a detailed view to a larger scale of part of a modified form of the apparatus shown in FIG. 1, FIG. 3 is a view similar to FIG. 2 but showing the modified apparatus in another position, FIG. 4 is a diagrammatic end view of a third form of apparatus, FIG. 5 is an end view, part in section, through a fourth form of apparatus, and FIG. 6 is a detail view drawn to a larger scale, of part of the apparatus shown in FIG. 5.

In the particular arrangement illustrated in FIG. 1, the apparatus is fitted at the output end of a carding machine, and 10 is the doffer roller which collects the carded fibrous material from the preceding cylinder or swift (not shown). On the doffer roller 10, the carded web is formed into the required thickness for subsequent processing by a condenser in the case of a wollen card or a sliver coiling mechanism in the case of a cotton card. It is usual to provide a doffer comb or a card-clothed stripper roller for the purpose of removing the carded web from the doffer, but in this arrangement, the doffer comb or card-clothed stripper roller is omitted.

The doffing apparatus which is provided by the present invention essentially consists of a stripping roller 12 and a blade 14. The roller 12 and the blade 14 co-operate to provide the means for removing the carded web of fibres from the doffer 10, and are fitted on the carding machine closely adjacent to the periphery of the doffer 10. Both the roller 12 and the blade member 14 extend across the full width of the doffer 10, and are thereby adapted to receive the full carded web as it is removed from the doffer.

The stripping roller 12 may be a solid roller, or it may be formed as a hollow member, but in any case, it has axle extensions 16 whereby it can be journalled in bearings carried by the carding machine frame, and at one end, it is connected by suitable gearing to the driving mechanism for the carding machine so that it is rotated in synchronism with the doffer roller 10. The doffer roller and stripping roller are rotated in the directions illustrated by the arrows 18 and 20 in FIG. 1, and the surface speed of the stripping roller may be equal to or greater than that of the doffer roller.

The stripping roller 12 has a polygonal cross-section, and the roller illustrated in FIG. 1 has sixteen sides 22, but it is to be understood that the stripping roller could have a different number of sides. Rollers having 12, 16 and 24 sides have proved satisfactory, but it is conceivable that stripping rollers having a smaller number of sides including even square and triangular stripping rollers, might be effective in some situations.

The blade-like member 14 consists of a relatively thin blade 24 made of resilient flexible material such as spring steel or nylon, carried by a pair of brackets 26 pivoted on co-axial pivot pegs 28 mounted on the machine frame. In this particular form of apparatus, it is not essential for the blade to be flexible or resilient. A tension spring 30 is connected between each of the brackets 28 and an anchor point 32 on a fixed part of the machine frame, and this spring tends to turn the bracket 26 in a clockwise direction as shown in FIG. 1, thus urging the blade 24 towards the periphery of the stripping roller 12. In FIG. 1, it will be observed that the blade 24 does not actually make contact with the surface of the roller 12, there being a stop (not shown) which prevents the spring 30 pulling the blade 24 into engagement with the surface of the stripping roller. Consequently, there is a narrow gap between the periphery of the stripping roller 12 and the surface of the blade 24 which faces the stripping roller, at the edge of the blade nearest to the doffer 10, and this gap is referred to as the "mouth" of the web removing apparatus.

The chain dotted line 25 in FIG. 1 is a radial plane passing through the axis of rotation of the stripping roller 12, and perpendicular to the surface of the blade 24, which forms one side of the mouth. It is to be observed, that in the arrangement shown in this figure, the extremity of the blade 24 coincides with the radial plane 25, and therefore the blade 24 only extends on the side of that plane which is remote from the doffer 10. It is to be understood however that the blade 24 could extend on both sides of the plane 25.

When the apparatus is in operation, the carded web of material removed from the doffer 10, passes through the mouth of the apparatus. Although the blade 24 remains stationary, the mouth is constantly opening and closing. Thus, when one of the corners such as 23, comes into line with the plane 25, the mouth is closed, because at that point, the periphery of the stripping roller 12, approaches nearest to the blade 24. However, from that point on, as the corner 23 continues its arcuate movement due to rotation of the stripping roller 20, the nip between that corner and the blade 24 is opening, until the fully opened position is arrived at as illustrated, wherein the blade 24 lies substantially parallel with one of the side faces 22 of the roller 12. The mouth at the line 25 on the other hand, opens during the first part of this travel of the nip and closes during the later part of the nip travel and continues to close until the following corner 23 arrives at the line 25. This continual opening and closing of the mouth has been found effective in pulling the web of material from the doffer roller at high speeds.

If an obstruction tends to enter the mouth of the apparatus, then the blade 24 is able to yield owing to the spring loading, to allow the obstruction to pass, without damage to the apparatus.

In a slightly different form of the invention shown in FIGS. 2 and 3, the apparatus is practically identical with that illustrated in FIG. 1, excepting that there is no stop and hence the spring 30 is allowed to pull the blade 24 into contact with the periphery of the stripping roller 12. The action of the apparatus is quite similar to that just described, and is illustrated in FIGS. 2 and 3. In such an arrangement, as the stripping roller 12 rotates, it produces an oscillation of the blade 24 about the axis 28, by virtue of the polygonal shape of the roller. Thus, when a corner such as 23 engages with the blade 24, it begins to turn the blade in an anti-clockwise direction, but as the point of contact of the corner 23 with the blade 24 moves through the arc produced by rotation of the stripping roller 12, the blade 24 is allowed to return under its spring loading in a clockwise direction, until the position is arrived at which is illustrated in FIG. 3, where the surface of the blade 24 which forms part of the mouth lies flat against one of the side walls 22 of the roller 12, and the mouth is fully closed. The fully opened position in fact arises shortly after the corner 23 engages with the blade 24 and is illustrated in FIG. 2.

Again therefore with the modified arrangement, there is still the opening and closing mouth action, which has been found efficacious, and in addition, it will be observed that the nip between the corner 23 and the blade 24 travels along part of the length of the blade. The combined opening and closing action and travel of the nip is rather similar to the action of a finger and thumb in plucking fibres from a web.

It will be appreciated, that if the blade 24 is required to oscillate, then it is possible to achieve this, without necessarily allowing the blade to engage with the polygonal surface of the stripping roller. For example, the blade-like member 14 could be caused to oscillate by a separate oscillatory mechanism, geared to the driving mechanism of the carding machine. On the other hand, the blade might be caused to oscillate by an electromagnetic oscillator. Again, with a stripping roller of cylindrical form, there could be a cam of a polygonal shape similar to that of the roller 12 shown in FIG. 1, but arranged at one end of the roller and engaging with a projection of the blade 24, in order to produce oscillation of the blade close to the periphery of the cylindrical stripping roller.

Referring now to the alternative arrangement shown in FIG. 4, again there is a polygonal stripping roller arranged close to the periphery of a card-clothed doffer roller 40. In this arrangement however, there is a spring steel blade 44, which extends across the width of the machine, and which is secured near to its lower edge to a block 46 having an axle 48 received in bearings (not shown) so that the block can turn about its own axis. An arm 50 is secured to the block 46 and extends between a pair of lugs 52 on a bracket 54 fixed to the carding machine frame. Adjusting screws 56 and 58 pass through screw threaded holes in the lugs 52 to engage respectively with the topside and bottomside of the arm 50.

The block 46 is positioned by adjusting the screws 56 and 58 so that the blade 44 is pressed into engagement with the periphery of the stripping roller 42, and indeed will normally be set so that the blade is bent as shown in the drawing. It will be appreciated that the pressure of the blade on the roller can be adjusted by means of the screws 56 and 58.

During rotation of the stripping roller 42, the blade 44 is caused to oscillate in the same manner as that described with reference to FIGS. 2 and 3 and this provides the opening and closing mouth and a travelling nip.

The apparatus shown in FIGS. 5 and 6 has been designed having regard to the problem of maintaining an even grip on the fibre web across the width of the machine, and in this connection, it should be mentioned that on wide carding machines the web may be three meters wide, so that there are real problems due to deflection and possible misalignment of parts of the web-removing apparatus. It is to be understood however that the arrangement shown in FIGS. 5 and 6 can be used on machines of any width.

The doffer roller is illustrated at 60, and a co-operating polygonal stripping roller is shown at 62. The disposition of the roller 62 is similar to that of the stripping roller previously described. Again there is a flexible and resilient blade 64 urged into engagement with the periphery of the stripping roller, to provide the opening and closing mouth effect previously described. It will be observed that the blade is applied to the stripping roller under some pressure so that the blade is bent. It is to be understood however, that the applied pressure in some instances may be quite small.

An angle iron support 66 extends across the width of the machine and is fixed to the machine frame. At a series of positions spaced transversely across the machine, there are pairs of lugs 68 fixed to the support 66, and each pair of lugs mounts an axle 70 on which a setting lever 72 is pivoted. A carrier rod 74—which must have some degree of resilience—is secured to the upper ends of the setting levers 72, and bridges all these levers as indicated in FIG. 6. A deep groove is formed throughout the length of the carrier rod, and this groove receives the bottom edge portion of the blade 64. Fastening screws 76 are if necessary provided to secure the blade in position. By virtue of this arrangement it is possible to remove and replace the blade quite easily it if becomes worn or requires attention.

Each lever 72 has an adjusting screw 78, which passes through a clearance hole in the lower part of the lever, and engages in a screw-threaded hole in the support 66. A compression spring 80 engages between the upright part of the support 66 and the lower part of the lever 72, urging the latter in an anti-clockwise direction as seen in FIG. 5 (i.e. tending to pull the blade 64 away from the stripping roller).

When the apparatus is set for working, each screw 78 is tightened to press its lever 72 against the spring 80, so as to press the blade 64 with the required force against the periphery of the stripping roller 62. By virtue of the fact that there is a series of levers 72, these can be adjusted independently of each other, if necessary deflecting the carrier rod 74 to ensure an even pressure of the blade 64 against the stripping roller across the width of the machine. If the apparatus is of the type in which there is a gap between the blade and the stripping roller, then the adjustment permits the carrier rod to be deflected as required to provide an even gap.

It will be understood that any one of the apparatus as illustrated can only function efficiently, if the distance between the tips of the teeth of the card clothing on the doffer roller 10 or 40 and the entrance to the mouth of the apparatus (which distance is indicated by the arrow $x$ in FIG. 2) is not greater than the average staple length of the material being carded. For any particular batch of textile fibres, it is possible to specify an average staple length, and by this term is meant the average length of the fibres which form the bulk of the fibre batch.

The stripping roller may have special formations to assist in gripping the web. Thus in one arrangement employing a polygonal roller as illustrated in the drawings, slits parallel to the end face of the roller are formed across each corner of the roller. The slits may be quite deep and could be formed in a helical fashion for ease of manufacture.

What is claimed is:

1. Apparatus for removing a carded web of fibres from a rotating member, comprising a stripping roller mounted adjacent said rotating member for rotation about its own axis, and a blade-like member at least part of which is disposed close to the periphery of the stripping roller and means for deliberately imparting predetermined continuous controlled oscillation of said blade-like member relative to the periphery of said stripping roller for continuous opening and closing of the mouth formed between the stripping roller and the blade-like member.

2. Apparatus as claimed in claim 1, in which said blade-like member is made of flexible material.

3. Apparatus as claimed in claim 1 in which a plurality of setting adjusting means are provided at spaced positions transversely of the width of the apparatus, and the arrangement is such that it is possible to effect localised adjustment of the setting of part of said blade-like member relative to said stripping roller.

4. Apparatus according to claim 1, wherein said stripping roller has a peripheral shape such that in rotation, it presents a succession of peripheral projections each of which projections is totally spaced in a circumferential direction about the axis of said stripping roller from adjacent projections to the point of closest approach of said blade-like member to said stripping roller, said blade-like member being spaced from said stripping roller, and said stripping roller having a polygonal cross-section, whereby edges formed on said roller at the corners of the polygon provide said peripheral projections.

5. Apparatus according to claim 1, wherein means is provided whereby said blade-like member is urged into engagement with said stripping roller, and said stripping roller has a peripheral shape such that in rotation, it presents a succession of peripheral projections each of which projections is totally spaced in a circumferential direction about the axis of said stripping roller from adjacent projections to the point of closest approach of said blade-like member to said stripping roller, said stripping roller having a polygonal cross-section, whereby said stripping roller itself provides said means for causing continuous oscillation of said blade-like member.

6. The apparatus defined in claim 1, wherein said blade-like member is mounted for oscillation about an axis parallel to the axis of rotation of said roller and is spring biased toward said roller periphery.

7. The apparatus defined in claim 6, wherein said oscillating means comprises means on the roller constructed and arranged to periodically positively displace said blade-like member against said spring bias.

8. The apparatus defined in claim 6, wherein said means on said stripping roller are surface projections for periodically engaging said blade-like member to effect said oscillation.

9. A method of removing a carded web of fibres from a rotary member bearing said carded web on its periphery comprising the steps of passing said web through a web receiving mouth having opposite sides extending adjacent said member along the width of said member, and continuously rotating one side of said mouth while deliberately imparting predetermined continuous controlled oscillation of the other side of said mouth to move toward and away from said one side to provide continual opening and closing of said mouth during passage of fibres therethrough.

10. A method of removing a carded web of fibres from the periphery of a rotating member comprising the steps of passing the web from said member through a mouth formed between a continuously rotating surface and a non-rotating surface while deliberately imparting predetermined continuous controlled oscillation of said non-rotating surface relative to said rotating surface so that said mouth is continuously opening and closing during passage of said web.

* * * * *